US005888148A

United States Patent [19]

Allen

[11] Patent Number: 5,888,148

[45] Date of Patent: Mar. 30, 1999

[54] GOLF CLUB HEAD WITH POWER SHAFT AND METHOD OF MAKING

[75] Inventor: Dillis V. Allen, Elgin, Ill.

[73] Assignee: Vardon Golf Company, Inc., Elk Grove Village, Ill.

[21] Appl. No.: 946,939

[22] Filed: Oct. 9, 1997

Related U.S. Application Data

[63] Continuation-in-part of Ser. No. 859,282, May 19, 1997.

[51] Int. Cl.[6] ..... A63B 53/04

[52] U.S. Cl. ..... 473/290; 473/337; 473/345; 473/346; 473/329

[58] Field of Search ..... 473/336, 337, 473/344, 345, 346, 329, 290

[56] References Cited

U.S. PATENT DOCUMENTS

| | | | |
|---|---|---|---|
| 3,637,218 | 1/1972 | Carlino | 473/337 |
| 5,228,615 | 7/1993 | Iijima | 473/345 |
| 5,242,167 | 9/1993 | Antonious | 473/350 |
| 5,346,217 | 9/1994 | Tsuchiya | 473/345 |
| 5,380,009 | 1/1995 | Henry | 473/346 |
| 5,464,211 | 11/1995 | Atkins | 473/377 |
| 5,547,427 | 8/1996 | Rigal | 473/345 |
| 5,586,948 | 12/1996 | Mick | 473/346 |
| 5,630,888 | 5/1997 | Yoshida | 473/324 |
| 5,718,641 | 2/1998 | Lin | 473/224 |

*Primary Examiner*—Sebastiano Passaniti
*Assistant Examiner*—Stephen L. Blau
*Attorney, Agent, or Firm*—Dillis V. Allen

[57] ABSTRACT

A golf club head with an internal power shaft that extends along the target line. In a high volume club head embodiment above 250 cm.$^3$, constructed of a low modulus alloy compared to stainless steel, the power shaft has a preload, or static compression, to increase the modulus of elasticity of the head and ball striking face. This preload technique is expanded in another embodiment into a semi-customized line of golf club woods, where the club head modulus of elasticity increases with the golfer's club head speed by progressively increasing preload in the club head line. The power shaft is press-fitted into the rear of the ball striking face to reduce bonding and welding difficulties in joining the power shaft to the ball striking face. The modulus of the face wall and the power shaft is enhanced by casting or welding the sole plate of the club head along an axial extent directly to the outer surface of the power shaft thereby increasing its columnar strength. This unique club is assembled by casting the club head in two pieces parting along a vertical plane parallel to the club face, one forward and one rear, and assembling the head by clamshelling the power shaft between the forward wall and rear pieces and then welding or otherwise bonding the forward and rear pieces together. By applying opposite axial clamping forces to the two club head pieces during and after welding or other heat bonding, the power shaft is preloaded into a static compression state.

44 Claims, 10 Drawing Sheets

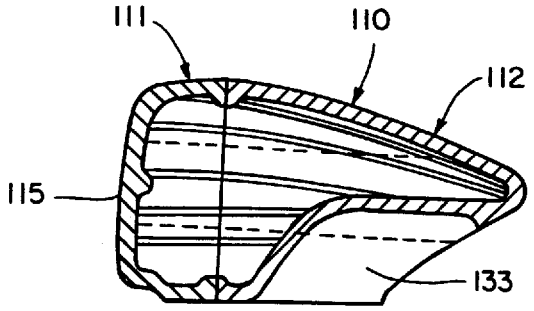
Fig. 30
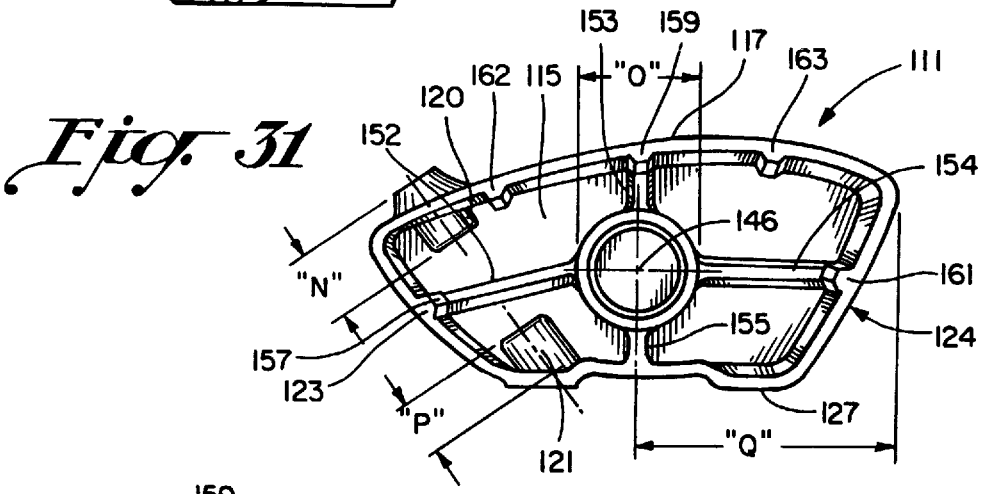
Fig. 31
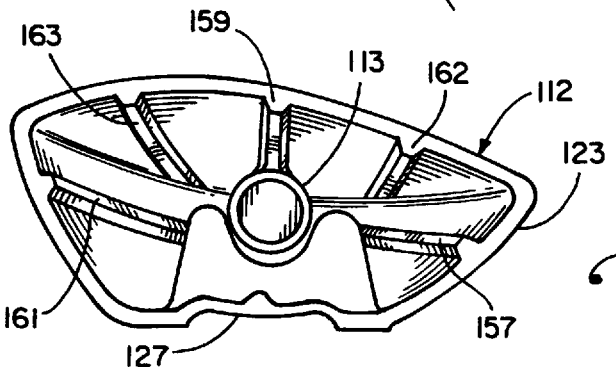
Fig. 32
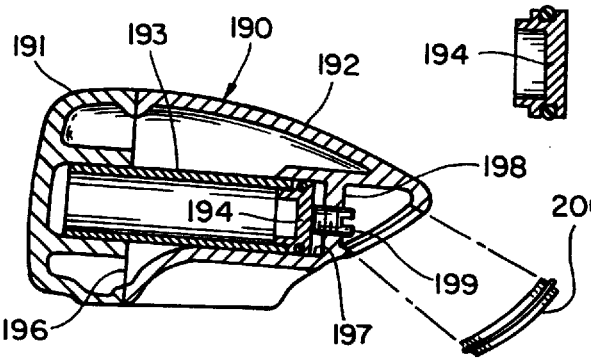
Fig. 33
Fig. 34

GOLF CLUB HEAD WITH POWER SHAFT AND METHOD OF MAKING

RELATED APPLICATION

This application is a Continuation-In-Part of my U.S. Ser. No. 08/859,282, Filed: May 19, 1997, entitled "OVERSIZE METAL WOOD WITH POWER SHAFT".

BACKGROUND OF THE INVENTION

Investment casting techniques innovated in the late 1960s have revolutionized the design, construction and performance of golf club heads up to the present time. Initially only novelty putters and irons were investment cast, and it was only until the early years of the 1980s that investment cast metal woods achieved any degree of commercial success. The initial iron club heads that were investment cast in the very late 1960s and early 1970s innovated the cavity backed club heads made possible by investment casting which enabled the molder and tool designer to form rather severe surface changes in the tooling that were not possible in prior manufacturing techniques for irons which were predominantly at that time forgings. The forging technology was expensive because of the repetition of forging impacts and the necessity for progressive tooling that rendered the forging process considerably more expensive than the investment casting process and that distinction is true today although there have been recent techniques in forging technology to increase the severity of surface contours albeit them at considerable expense.

The investment casting process, sometimes known as the lost wax process, permits the casting of complex shapes found beneficial in golf club technology, because the ceramic material of the mold is formed by dipping a wax master impression repeatedly into a ceramic slurry with drying periods in-between and with a silica coating that permits undercutting and abrupt surface changes almost without limitation since the wax is melted from the interior of the ceramic mold after complete hardening.

This process was adopted in the 1980s to manufacture "wooden" club heads and was found particularly successful because the construction of these heads requires interior undercuts and thin walls because of their stainless steel construction. The metal wood club head, in order to conform to commonly acceptable club head weights on the order of 195 to 210 gms. when constructed of stainless steel, must have extremely thin wall thicknesses on the order of 0.020 to 0.070 inches on the perimeter walls to a maximum of 0.125 inches on the forward wall which is the ball striking surface. This ball striking surface, even utilizing a high strength stainless steel such as 17-4, without reinforcement, must have a thickness of at least 0.125 inches to maintain its structural integrity for the high club head speed player of today who not uncommonly has speeds in the range of 100 to 150 feet per second at ball impact.

Faced with this dilemma of manufacturing a club head of adequate strength while limiting the weight of the club head in a driving metal wood in the range of 195 to 210 gms., designers have found it difficult to increase the perimeter weighting effect of the club head.

In an iron club, perimeter weighting is an easier task because for a given swing weight, iron club heads can be considerably heavier than metal woods because the iron shafts are shorter. So attempts to increase perimeter weighting over the past decade have been more successful in irons than "wooden" club heads. Since the innovation of investment casting in iron technology in the late 1960s, this technique has been utilized to increase the perimeter weighting of the club head or more particularly a redistribution of the weight of the head itself away from the hitting area to the perimeter around the hitting area, usually by providing a perimeter wall extending rearwardly from the face that results in a rear cavity behind the ball striking area. Such a club head configuration has been found over the last two plus decades to enable the average golfer, as well as the professional, to realize a more forgiving hitting area and by that we mean that somewhat offcenter hits from the geometric center of the face of the club results in shots substantially the same as those hits on the center of the club. Today it is not uncommon to find a majority of professional golfers playing in any tournament with investment cast perimeter weighted irons confirming the validity of this perimeter weighting technology.

Metal woods by definition are perimeter weighted because in order to achieve the weight limitation of the club head described above with stainless steel materials, it is necessary to construct the walls of the club head very thin which necessarily produces a shell-type construction where the rearwardly extending wall extends from the perimeter of the forward ball striking wall, and this results in an inherently perimeter weighted club, not by design but by a logical requirement.

In the Raymont, U.S. Pat. No. 3,847,399 issued Nov. 12, 1974, assigned to the assignee of the present invention, a system is disclosed for increasing the perimeter weighting effect of a golf club by a pattern of reinforcing elements in the ball striking area that permits the ball striking area to be lighter than normal, enabling the designer to utilize that weight saved on the forward face by adding it to the perimeter wall and thereby enhancing perimeter weighting.

This technique devised by Mr. Raymont was adopted in the late 1980s by many tool designers of investment cast metal woods to increase the strength of the forward face of the metal woods to maintain the requirement for total overall head weight and to redistribute the weight to the relatively thin investment cast perimeter walls permitting these walls to not only have greater structural integrity and provide easier molding and less rejects, but also to enhance the perimeter weighting of these metal woods.

Another problem addressed by the present invention is the achievement of increasing the benefits of perimeter weighting by simply adding weight to the perimeter of the club head itself. This technique, of course, has found considerable success in low impact club heads such as putters, where overall club head weight is in no way critical, and in fact in many low impact clubs that have found considerable commercial success, the club heads weigh many times that of metal wood heads, sometimes three or four times as heavy.

Increased perimeter weighting has been found difficult because of the weight and impact strength requirements in metal woods. An understanding of perimeter weighting must necessarily include a discussion of the parameter radius of gyration. The radius of gyration in a golf club head is defined as the radius from the geometric or ball striking axis of the club along the club face to points of club head mass under consideration. Thus, in effect the radius of gyration is the moment arm or torquing arm for a given mass under consideration about the ball striking point. The total moments acting on the ball during impact is defined as the sum of the individual masses multiplied by their moment arms or "radii of gyration". And this sum of the moments can be increased then by either increasing the length of the individual moment arms or by increasing the mass or face acting at that moment arm or combinations of the two.

Since it is not practical, except for the techniques discussed in the above Raymont and Allen patents, to add weight to the perimeter wall because of the weight limitations of metal woods and particularly the driving woods, one alternative is to increase the moment arm or radius of gyration. This explains the popularity of today's "jumbo" woods although many of such woods do not have enlarged faces because of the requirement for structural integrity in the front face.

In the Allen, U.S. Pat. No. 5,397,126, an improved metal wood golf club is provided having an enlarged or "jumbo" metal club head with a crowned top wall extending rearwardly from a ball striking face wall, a toe wall, and a heel wall also projecting rearwardly from the face wall—but the club head has no conventional sole plate.

The toe wall and the heel wall are enclosed by the top wall and a pair of spaced generally vertical weighting walls integral with and extending rearwardly from the face wall. The two areas enclosed by the top wall, heel and toe walls, and weight walls are hollow to achieve the desired head weight and the area between the walls is opened, and the weight of the sole plate that normally encloses that area is redistributed to the weight wall to achieve true heel and toe weighting.

Prior attempts to manufacture very large stainless steel metal club heads with larger than normal faces has proved exceedingly difficult because of the 195 to 210 gm. weight requirements for driving club heads to achieve the most desirable club swing weights. Thus, to the present date stainless steel "jumbo" club heads have been manufactured with standard sized face walls, deeply descending top walls from the front to the rear of the club head, and angular faceted sole plates all designed to decrease the gross enclosed volume of the head but which do not detract from the apparent, not actual, volumetric size of the head. This has led to several manufacturers switching from stainless steel to aluminum and titanium alloys, which are of course lighter, to enlarge the head as well as the face.

It has also been suggested in the past that various rods and shafts be cast or attached into the club head for the purpose of rigidifying the forward face wall. However, to the present date, such designs have not achieved any significant commercial success.

The first problem is that, while some of the prior art suggests casting the rods with the forward face, as a practical matter this has never been achieved because of the extreme difficulty in removing the core pieces around the shaft due to interference with the walls of the club head.

A second problem that is not addressed in this prior art is that in order to be effective in reinforcing the front face, the rods need to be integrated into the club head. The rod must also have a weight in the range of 20 to 30 gms. If one simply adds 20 to 30 gram element to a 200 gm. head, the resulting weight of 220 to 230 gms. is excessive and will result in a swing weight far higher than acceptable to the present day average golfer.

An additional problem in many of these prior rigidifying elements is that they are constructed of a low modulus material such as plastic or graphite compositions. These materials do not significantly increase the resonant frequency or the rebound of the face wall. Ideally, the rebound of the face wall; that is, the return of the face wall to its relaxed configuration, should occur at approximately the time the ball exits the face wall. In this way the rebound of the face wall assists in propelling the ball from the club face. If rebound occurs after the ball exits the face wall, the benefits of this effect are completely lost. None of the prior art dealing with these reinforcing elements suggests utilizing this technique for matching face wall rebound with ball exit from the face wall.

A further problem in the prior art references which suggest utilizing these rigidifying elements, is that they are completely silent on how these reinforcing elements, when not cast into the face wall, are attached into the club head. And the method of attachment, as will be seen from the present invention, is critical to the benefits of increasing resonant frequency and rebound of the face wall in accordance with the present invention. Presently known bonding techniques are not sufficient to yield these benefits.

Still another of these prior references suggests making the head of synthetic material and the support rod of a similar material, but these low modulus and soft materials cannot significantly raise the resonant frequency or rebound time of the ball striking face wall.

The following patents or specifications disclose club heads containing face reinforcing elements:

FOREIGN PATENTS

British Patent Specification, No. 398,643, to Squire, issued Sep. 21, 1933;

UNITED STATES PATENTS

Clark, No. 769,939, issued Sep. 13, 1904
Palmer, No. 1,167,106, issued Jan. 4, 1916
Barnes, No. 1,546,612, issued Jul. 21, 1925
Drevitson, No. 1,678,637, issued Jul. 31, 1928
Weiskoff, No. 1,907,134, issued Apr. 2, 1933
Schaffer, No. 2,460,435, issued Feb. 1, 1949
Chancellor, No. 3,589,731, issued Jun. 29, 1971
Glover, No. 3,692,306, issued Sep. 19, 1972
Zebelean, No. 4,214,754, issued Jul. 29, 1980
Yamada, No. 4,535,990, issued Aug. 20, 1985
Chen, et al., No. 4,681,321, issued Jul. 21, 1987
Kobayashi, No. 4,732,389, issued Mar. 22, 1988
Shearer, No. 4,944,515, issued Jul. 31, 1990
Shiotani, et al., No. 4,988,104, issued Jan. 29, 1991
Duclos, No. 5,176,383, issued Jan. 5, 1993
Atkins, No. 5,464,211, issued Nov. 7, 1995
Rigal, et al., No. 5,547,427, issued Aug. 20, 1996

In the Squire British Specification 398,643, the reinforcing rods 10 and 18 are primarily for the purpose of reducing ringing in the face. Squire makes no attempt to maintain head weight within acceptable limits and is completely silent on how the rod 10 can be cast inside the head while removing the core pieces therefrom. Squire is also silent on the rebound or resonant frequency on the head.

The Clark, U.S. Pat. No. 769,939, shows a movable rod that assists in propelling the ball from the club face.

The Palmer, U.S. Pat. No. 1,167,106 shows a weighting element that does not extend completely through the club head.

The Barnes, U.S. Pat. No. 1,546,612, shows rods 13 and 14 extending into the club head, but these rods are for attachment purposes of the face 10 and the club is not a perimeter weighted club.

The Drevitson, U.S. Pat. No. 1,678,637, shows reinforcing partitions 55, but these are not concentrated directly behind the ball striking area, and thus, while rigidifying the face, do not concentrate mass transfer directly to the ball.

The Weiskoff, U.S. Pat. No. 1,907,134, shows a reinforcing member near the center of the club face, but such is not concentrated specifically in the ball striking area and is not a high modulus material.

The Schaffer, U.S. Pat. No. 2,460,435, shows a labyrinth of webs molded in the club head, but the club head is not a high modulus material, nor is the club face and the core 11 is aluminum and not constructed of the same material as the club head.

The Chancellor, U.S. Pat. No. 3,589,731, shows a movable weight between the back and the front of the club that allegedly corrects hooking and slicing.

The Glover, U.S. Pat. No. 3,692,306, shows a weight port integral with the club face in FIG. 6, but Glover's club head is a low modulus resin and is not perimeter weighted.

The Zebelean, U.S. Pat. No. 4,214,754, shows support members 32 in FIG. 10, but they are not connected to the face nor are they concentrated behind the sweet spot.

The Yamada, U.S. Pat. No. 4,535,990, shows a shaft between the rear of the face wall and a back portion of the club, but the Yamada club head is not a high modulus material, and the patent is silent as to how the reinforcement member 31 is connected into the club head cavity.

The Chen, et al., U.S. Pat. No. 4,681,321, shows webs 31 molded inside the club head, but both the club head and the webs are low modulus materials.

The Kobayashi, U.S. Pat. No. 4,732,389, shows a brass plate and a rod that engage the rear of the ball striking face, but the patent is silent as to how it is attached to the face and the club head is solid wood and not a perimeter weighted club head.

The Shearer, U.S. Pat. No. 4,944,515, shows a shaft 24 either cast or attached inside the club head. The Sheer patent is silent as to how the shaft could be cast in the club head and in the alternative suggests that it be fixed in after the club head is made, the patent is silent as to how it might be fixed inside.

The Shiotani, et al., U.S. Pat. No. 4,988,104, shows an insert 15 that is insert molded inside the golf club head, but the club head is a resin type low modulus material, and there is no specific attachment of the insert into the head other than that which results from the insert molding process.

The Duclos, U.S. Pat. No. 5,176,383, discloses a low modulus graphite head having a rod formed on the rear of the ball striking face. The low modulus head provides the Duclos club with minimal perimeter weighting.

The Atkins, U.S. Pat. No. 5,464,211, shows a plate 30 that is threaded from the rear of the club against the forward face which he refers to as a "jack screw". The plate 30 is epoxied to the rear of the face wall and such a design will fail under the extreme high impact loadings of a 150 ft./sec. impact with a golf ball.

The Rigal, et al., U.S. Pat. No. 5,547,427, shows partitions. In the FIG. 9 embodiment, the rod 74 is placed in tension which detracts from rigidifying the front face. In the FIG. 10 embodiment, the rod 23 is not integral with the front face.

A further principle problem addressed in the present invention has resulted from the use of light-weight alloys to produce "jumbo" or oversized metal woods that are particularly popular in today's golfing market. These use light-weight metals such as high titanium alloys that permit the club head to be made larger, providing increased perimeter weighting and an easier to hit larger sweet spot. However, there is a trade-off to this large sweet spot and that is a diminution in ball distance travel or in short, the ball does not travel as far as it does with smaller stainless steel heads, which concentrate more mass behind the ball. This in part explains why professionals on the regular tour rarely use very large titanium club heads.

This diminution in ball distance in jumbo titanium alloys, or other light-weight alloy heads, is believed caused by three factors. First, the very large club heads spread the perimeter wall support points from the ball striking area, causing the face to flex more than smaller heads resulting in a badly delayed rebound of the face. If one can imagine a flat horizontal 1"×6" pine board supported at points two feet apart and a similar board supported at points 10 feet apart, both with a 200 lb. weight in the middle of the boards, the second board will bend substantially more. This oversimplified is what causes in part the greater face flexure in the jumbo metal woods. Secondly, while titanium is a hard material, it has a modulus of elasticity less than half that of ferrous alloys. The lower the modulus, the greater the strain or deflections, for a given load. It should also be noted that today's high titanium alloy jumbo metal wood heads with volumes in the range of 250 to 300 cm.$^3$, have relatively thin wall thicknesses, less than 0.125, and in some cases substantially less than 0.125 inches, which exacerbates the problem of face flexure and slow face rebound.

These three factors all contribute to an incomplete face recovery during ball impact. That is, the club face bends inwardly at ball impact to a state of tension and then returns at some point in time to its normal relaxed position. The rebound of the club face, or its return to its relaxed position, should ideally assist in propelling the ball from the club face. In these prior high titanium jumbo club heads however, the face wall does not fully recover until after the ball leaves the club face, thereby dissipating as waste a portion of the club head energy.

In my parent application, U.S. Ser. No. 08/859,282, Filed: May 19, 1997, a high modulus golf club head of the "wood" type is provided with a power shaft, a rod for increasing the resonant frequency and decreasing the rebound time of the face, integral at its forward end with the ball striking wall behind the sweet spot and integral with a rear portion of the club head at its rear end. While others have attempted supports for other purposes such as face reinforcement and club sound or feel, they have not been successful because these clubs are either not possible to manufacture, or will fail under the rigors of a 100 to 150 ft./sec. impact velocity against a golf ball.

In that application a jumbo club head in the range of 250 to 300 cm.$^3$ is disclosed constructed of a hard, light-weight alloy such as titanium or beryllium, with an integral power shaft extending from behind the club face sweet spot to a rear portion of the club head.

The power shaft according to the parent application was constructed of a metal alloy substantially similar to the metal alloy of the club head so it can be welded or fixed integrally to the sweet spot on the rear of the face wall and cast, welded or fixed integrally to a rear portion of the club head at its rear end. While welding similar metals is certainly not a new concept, it is difficult to weld, for example, a 0.625 inch diameter shaft with a 0.035 to 0.049 inch wall thickness directly to the club head face wall and rear wall because the face wall and rear wall, because of their large areas, require higher heating and welding temperatures resulting in heat distortion of the face wall and rear club head.

To obviate this problem, the parent application discloses a face wall sweet spot and the rear club head portion with cast in annular retainer walls to which the power shaft is welded. These retainers buff the heat sink effect of the face wall and club head portion and minimize heat distortion in these surfaces during welding.

The power shaft according to that invention is a compromise between club head designs to enhance perimeter weighting and increase the sweet spot area, and the ball distance producing designs that concentrate more mass directly behind the ball at impact.

Hence, I disclose in U.S. Ser. No. 08/859,282, a compromise between increased radius of gyration and increased ball distance to which the present invention is also directed. The ideal long driving club is not perimeter weighted, it is instead a solid brass rod having the diameter of a U.S. quarter and a length of four inches with a shaft aligned so the long driver hits the ball with one end of the brass rod. This design concentrates 100% of the mass of the club head on the flattened rear surface of the ball at impact.

This is the ideal design for ball distance or the long ball, but even long driving professionals would not use such a club in competition because even with their skills slightly off center hits, on the order of ⅛", produce poor results. But it should be noted here that most professional long drivers do use relatively small heads to concentrate mass more closely to the center of the ball.

According to the present invention and my parent application, this compromise is achieved by combining an oversize high modulus perimeter weighted metal wood of light weight material with an integrally formed power shaft of similar material.

There is a distinct advantage in embodying this design in a high titanium alloy instead of stainless steel which has a weight about 60% of stainless, on the order of 4.54 grams per $cm^3$, because the head can be made larger than 230 $cms^3$, and the power shaft can be made heavier than in stainless while maintaining total club head weight around 200 grams. Hence, the present design is particularly advantageous to club heads cast or forged in high titanium or similar alloys.

Another important aspect of the present invention and my parent application is the customizing of the golf club to the swing speed of the golfer. Golfers swing speed differ radically from about 88 ft/sec. up to as much as 180/ft/sec. (123 mph). The club face at impact becomes concave and before or after the ball leaves the face, the face rebounds to its natural shape. The time the ball remains on the face is surprisingly about the same for the slow swings and the fast, but the harder swinger will compress the ball further. Ideally, for both the fast and slow swinger, the face will rebound precisely as the ball is exiting the face to enhance ball exit velocity. But to do this, bearing in mind time of impact, about 5–7 milli/sec., is about the same for all swing speeds, the face must recover at a faster rate for the high speed swing because it has a greater face deflection. To achieve this, the present line of woods gives the higher speed swinger a progressively higher face wall resonant frequency than the lower speed swing. Numerous studies have been made analoging the natural or resonant frequencies of bodies to the rebound of the bodies after bending or deformation and those have been adopted here. But it should be noted however, the natural frequency of all linear structures increases with increasing stiffness and decreases with increasing mass.

In a free body system, the natural frequency of the system f is equal to $$\frac{1}{2\pi}\frac{(K)}{M}^{1/2}$$

where f is in cycle per unit of time, of a beam pinned at both ends and center loaded, as the face of a golf club, the spring constant K; i.e., force/unit deflection at point of L and is equal to $$\frac{3EI}{L^3}$$

when E is the modulus of elasticity of the material, I is the moment of inertia, and L is the unsupported length.

While titanium is a very hard material, it has a relatively low modulus(E) of 16.8 psi×$10^{-6}$ compared to stainless steel, which is 30 psi×$10^{-6}$. And the natural frequency varies as $\sqrt{E}$ when E is the modulus of elasticity.

Hence, it is when equating the rebound of a titanium face to that of steel the titanium face must be stiffened significantly more and in quantified amounts, and the present invention provides the tools to do that.

As noted above while golfer swing speeds differ greatly, time of ball impact does not and total club head weight stays in the range of 195 to 205 grams for most all swing speeds. Thus to achieve face frequency matching to swing speed, my parent application provided a means to vary face stiffness while maintaining about the same overall head weight.

Toward this end the face wall was stiffened in U.S. Ser. No. 08/859,282, by selecting a power shaft of varying wall thickness, which of course are of different weight, to equate the weights, the rods are provided with transverse weight ports for high density weights, that yield the same overall weight to the club head but varying stiffness and natural frequency to the club face. In this way, faster face rebound is provided for the higher speed golfer and hence slower face rebound for the slower speed golfer to assure that face rebound coincides with ball exit event on the club face.

Using these philosophies, a line of relatively high modulus metal woods was developed, and while stainless steel can be used, the choice is lighter weight alloys having a high surface hardness such as a high titanium or a high beryllium alloy. Utilizing a single club head body tool(the club head bodies are the same initially as are their face walls), the system includes a plurality of inter-changeable power shafts providing increasing stiffness and resonant frequency to the ball striking wall, beginning with thin walled shaft for the slower swinger and progressing to a heavy wall shaft for maximum stiffness and higher resonant frequency for the higher swing speed club.

SUMMARY OF THE PRESENT INVENTION

In accordance with the present invention, a golf club head with a power shaft is provided with an increased modulus of elasticity by preloading the power shaft, and a method of making a golf club head with and without preload is disclosed wherein the club head is cast or formed in forward and rear pieces along a generally vertical parting line, and the two pieces are assembled in clamshell fashion over the power shaft and thereafter the forward and rear pieces are joined by welding or otherwise bonding while the power tube is held in place. In a high volume club head embodiment, above 250 $cm.^3$, constructed of a low modulus alloy compared to stainless steel, the power shaft has a preload, or static compression, to increase the modulus of elasticity of the head and ball striking face. This preloading technique is expanded in another embodiment into a semi-customized line of golf club woods, where the club head modulus of elasticity increases with the golfer's club head speed by progressively increasing preload in the club head line. The power shaft is press fitted into the rear of the ball striking face to reduce bonding and welding difficulties in joining the power shaft to the ball striking face. The modulus of the face wall and the power shaft is enhanced by casting or welding the sole plate of the club head along an axial extent directly to the outer surface of the power shaft thereby increasing its columnar strength. By applying opposite axial clamping forces to the two club head pieces during and after welding or other heat bonding, the power shaft is preloaded into a static compression state. When the forward and rear pieces are joined by welding, the axial force application is maintained for a predetermined time after welding and assures that weld relaxation and wall relaxation will not significantly reduce the power shaft preload.

Toward these ends, the club head assembly, in one embodiment of the present invention, represents a deviation and improvement from the golf club head disclosed and claimed in my parent application, U.S. Ser. No. 08/859,282. In this application, the difficulties in joining the power shaft to the club head have been significantly reduced by a non-invasive joining method. That is, the power shaft is joined to one or both of the club head forward and rear pieces without requiring entry into the club head cavity with a welding tool or other joining instrument. This is accomplished by the provision of a tapered socket and cooperating tapered projection on the power shaft that when forced together under high pressure, the press-fitted tapers create a joint far superior to other bonding techniques, such as epoxy, and one that eliminates heat distortion and other problems associated with the welding of the power shaft.

The power shaft may be cast with one of the forward and rear pieces, but preferably it is initially formed separately therefrom. As a manufacturing expedient, it is preferred to form the power shaft as a separate molding or forging because it is difficult to control the power shaft dimensional integrity when cast integrally with either the forward or rear piece.

The sole plate has a concave spheroidal central portion that extends upwardly toward the power shaft. The sole plate has edges that are welded or integrally cast with axial portions of the sides of the power shaft. This design significantly increases the columnar modulus of elasticity of the power shaft without increasing weight because it uses the sole plate as a support, and in effect the power shaft forms a part of the sole plate to further increase the strength of the sole plate itself. This is also a significant weight saving technique. Firstly, because the power shaft forms part of the sole plate, sole plate weight is reduced, and secondly, the power shaft modulus is increased without any increase in weight in the power shaft.

Another aspect of the present invention is the incorporation of the power shaft preloading technique into an entire line of "wood" type club heads. In this embodiment, variable modulus of elasticity of the club head face wall is achieved, not by providing variable power shaft wall thickness, as in my parent application, but rather by varying the magnitude of the static preload of the power shaft acting on the rear face of the club head ball striking wall. Preload variation is carried through a semi-customized line of drivers(or fairway woods) including, for example, four differently preloaded drivers. The first driver is designed for the very low swing speed golfer, the fourth for the highest swing speed golfer. With this technique, the first driver has a power shaft preload of about 20 kg., and the fourth has a preload of about 100 kg. The second and third drivers in the line have proportionately intermediate preloads for the intermediate swing speeds.

In short, a high swing speed golfer plays with the highest preload club head, and the lower swing speed golfer plays with a progressively lower preloads depending upon their individual swing speeds.

The present preloaded power shaft construction is particularly useful in lightweight alloy club heads such as titanium alloys. These lightweight alloys have a low modulus of elasticity relative to steel, and the widespread use of these alloys in jumbo heads in excess of 240 $cm.^3$ in volume, results in an excessively flexible face walls that do not rebound while the ball remains in engagement with the face at impact to augment the impulse provided to the ball by the club head. That is, face rebound is so late it does not contribute, as it should, to ball exit or initial ball velocity from the club face. By preloading the power shaft in these lightweight alloy jumbo heads, the face wall rebound can be easily adjusted by the club head designer to obtain the maximum ball exit velocity for the particular club head design he is working with. That is, there are other factors or variables besides the particular alloy and club head size that affect face rebound timing, and the club head designer can utilize the present technique of variable preload experimentation in conjunction with ball impact testing to ascertain the appropriate preload that best suits his specific club head design.

Other objects and advantages of the present invention will appear more clearly from the following detailed description.

BRIEF DESCRIPTION OF THE DRAWINGS

FIG. 30 is a longitudinal section of the club head illustrated in FIGS. 24 to 29, taken through a vertical plane parallel to the plane of FIG. 29 and spaced outwardly toward the toe;

FIG. 31 is a rear sub-assembly view of the as cast forward portion of the club head prior to assembly;

FIG. 32 is a front view of the as cast rear portion of the club head illustrated in FIGS. 24 to 30;

FIG. 33 is a sub-assembly view of a piston utilized in the club head embodiment illustrated in FIG. 34;

FIG. 34 is a longitudinal section, taken in the same plane as FIG. 29, of a modified embodiment of the present club head assembly, and;

DETAILED DESCRIPTION OF THE PREFERRED EMBODIMENTS

The following description relates to the embodiment of the present invention shown in FIGS. 1 to 21, and this description is a verbatim repetition of the specification in my parent application, Ser. No. 08/859,282, filed May 19, 1997. The embodiment disclosed and claimed in this application is shown and described thereafter with reference to FIGS. 22 to 35.

Figure 1:
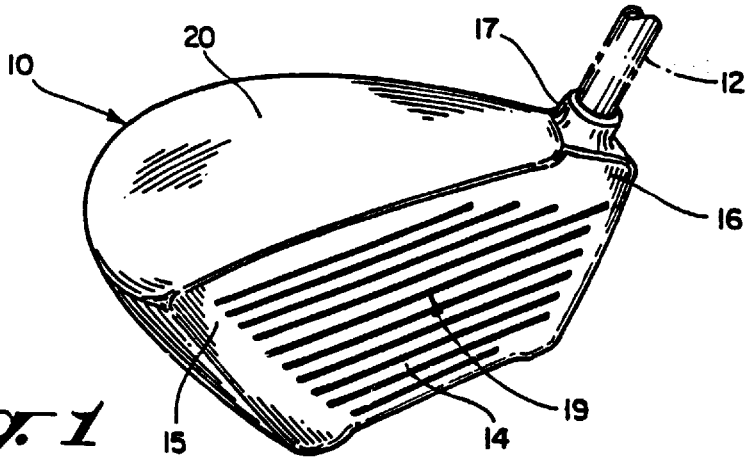
FIG. 1 is a perspective view of a golf club according to the present invention having its shaft truncated.
Figure 2:
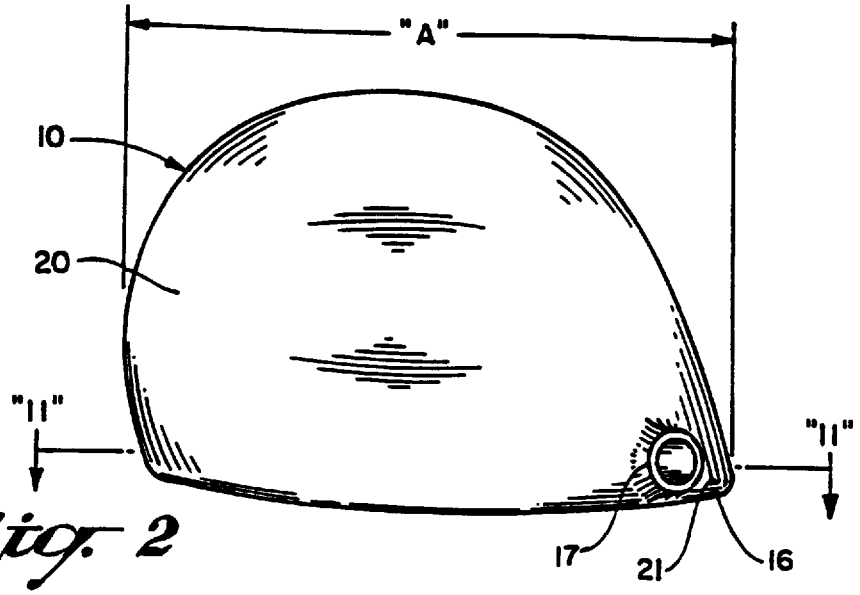
FIG. 2 is an enlarged top view of the club head illustrated in FIG. 1 without any shaft.

Referring to the drawings and particularly FIGS. 1 to 8, a club head 10 is illustrated which takes the general configuration of what is termed a "metal wood" in the golf industry, and as seen in FIG. 1, is implanted with a shaft 11 shown only in fragmented form which carries at its upper end a conventional grip. A golf club as defined in the present invention includes a club head with shaft 11 fixed therein which carries the shown grip at its upper distal end.

Many of the views in the present drawings including FIGS. 2, 3, 4, 5, 6, 7, 8, 9, 10, 11, 14, 15, 16, 17, and 18 are shown approximately to scale and in fact are about 5 to 10% smaller than a 1-1 scale.

The club head 10 has an included volume of 260 $cm.^3$, but could range from 230 to 300 $cm.^3$. "Included" volume is defined as the volume encompassed to the outermost walls of the club head that includes recessed areas that are not actually enclosed by walls such as a bottom wall cavity.

The club head 10 is constructed entirely of a relatively high modulus castable or forgible metal alloy and is particularly best embodied in a light-weight hard surfaced alloy such as a high titanium or beryllium alloy. However, it should be understood that other alloys, for example, a 17-4 stainless steel alloy, can also be utilized with some of the features of the present invention, but the light-weight alloys such as titanium and beryllium, are better suited to achieve the desired balance between an oversized club head on the order of 250 to 300 cc. combined with the present power shaft to provide an overall club head weight, including the power shaft, in the range of 190 to 205 gms. This combination is far easier achieved with the light-weight high hardness alloys such as titanium and beryllium. Because it is an object of the present invention to achieve a high resonant frequency ball striking face, it must be understood that high titanium alloys, for example, have a relatively low modulus on the order of 14 $10^{-6}$ psi compared to some $30\times10^{-6}$ psi for the ferrons metal alloys. Since as noted above the objects of the present invention are achieved by increasing, and varying, the resonant frequency of the ball striking face of the club head utilizing a series of variably configured power shafts, it is necessary in the relatively lower modulus lighter metal alloys that the ball striking face be stiffened to a somewhat greater extent than is necessary in the high modulus metal alloys such as stainless steel. While at the present time the high titanium alloys are preferred by most metal wood golf club designers over stainless steel alloys, the choice is somewhat dictated by the fact that high titanium alloys weigh only 60% of the stainless steel alloys, so it is far easier for the designer to have a greater design flexibility with titanium than with stainless steel. The trade-off, however, is that very large golf club heads in titanium or similar material, while providing excellent perimeter weighting for the high handicap golfer, their low modulus compared to stainless steel, increases flexure and lowers the resonant frequency of the front face. So low that the rebound of the face is significantly delayed until after ball exit which detracts from maximum ball travel. Ball distance travel in these extremely oversized heads is also diminished because of a lack of mass concentration directly behind the hitting area which, of course, is the antithesis of what many of today's designers are attempting to achieve with exaggerated perimeter weighting.

As noted above, the present invention has its objective of providing an oversized head, and at the same time compromising the effects of perimeter weighting with the present power shaft that is positioned directly behind the ball impact area on the front face of the club head.

Another advantage in utilizing a light-weight alloy for the head 10 is that it permits a greater concentration of mass in the power shaft than can be achieved with the higher density alloys. That is, in a stainless steel head it is difficult to produce an oversized or jumbo head unless the weight of the power shaft is 10% or less of the weight of the remaining head; i.e., on the order of 20 gms. Utilizing a high titanium alloy, however, it is possible to increase the weight of the power shaft to as high as 25% of the weight of the remaining head, or on the order of 50 gms. This provides considerably more design flexibility in power shaft variations when utilizing high titanium alloys. However, there is a greater need for a higher weight concentration in the titanium or light-weight alloy metals simply because the front face modulus is lower in these club heads.

Again referring to FIGS. 1 to 8, the present club head 10 is seen to generally include an open area 11 as seen in FIGS. 5, 6 and 8, in which a cylindrical power shaft 12 is integrally fixed.

The power shaft 12 is constructed of the same or substantially similar metal alloys as that of the club head 10 because the power shaft is welded at both its forward and rear end into the club head 10 to provide the appropriate structural integrity for not only the club head 10 but for reinforcing the club face and achieving the desired resonant frequency and rebound of the club face. The term "integral" as defined herein, includes welding, integral casting and press fitting. It does not include bonding with epoxy or other adhesives.

One of the purposes of the power shaft 12 is to vary the resonant frequency and the rebound of the forward face of the club for the individual player so club face rebound will apportionately coincide with the ball exit from the club face and assist in propelling the ball forwardly.

Club head 10 includes a forward ball striking wall 14 having an extended toe portion 15 and a heel portion 16 that extends outwardly from a hosel portion 17 in a direction opposite of ball striking area 19 on the club face. This geometry defines the hosel 17 as being an "inset" hosel in the sense that the axis of the hosel is inset toward the ball striking area 19 from the heel portion of the club head.

Figure 3:
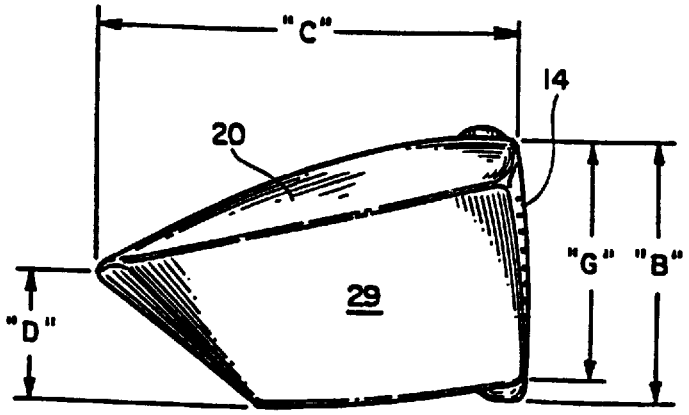
FIG. 3 is a left side view of the club head illustrated in FIG. 1.

A top wall 20 is formed integrally with the front face and projects rearwardly and downwardly therefrom as seen clearly in FIG. 3. Top wall 20 also wraps around the hosel and has a heel portion 21 that joins with face heel portion 16 on the side of the hosel 17 opposite the ball striking area 19, also in part defining the inset relationship of the hosel 17.

Figure 4:
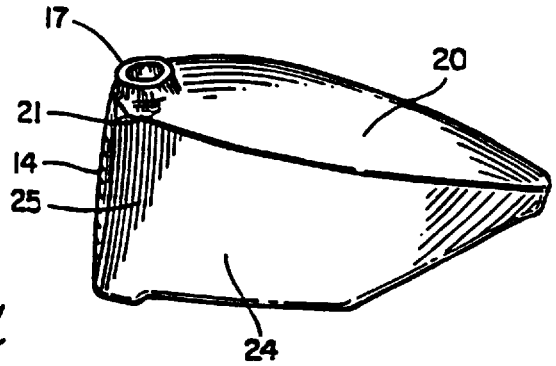
FIG. 4 is a right side view of the club head illustrated in FIGS. 1 to 3.

As seen in FIG. 4, a heel wall 24 is provided joined integrally with top wall 20 and face wall 24 that has a heel portion 25 that joins with the face heel portion 16 and the top wall heel portion 21 in a direction opposite hitting area 19 from the axis of hosel 17 to again define the inset relationship. It should be noted at this point that the walls of the club head 10, when constructed of stainless steel, are on the order of 0.050–0.070 in. in thickness except face wall 14, which is approximately 0.100 in. underneath the honeycomb reinforcement network 28 shown in FIG. 5, for example.

Figure 5:
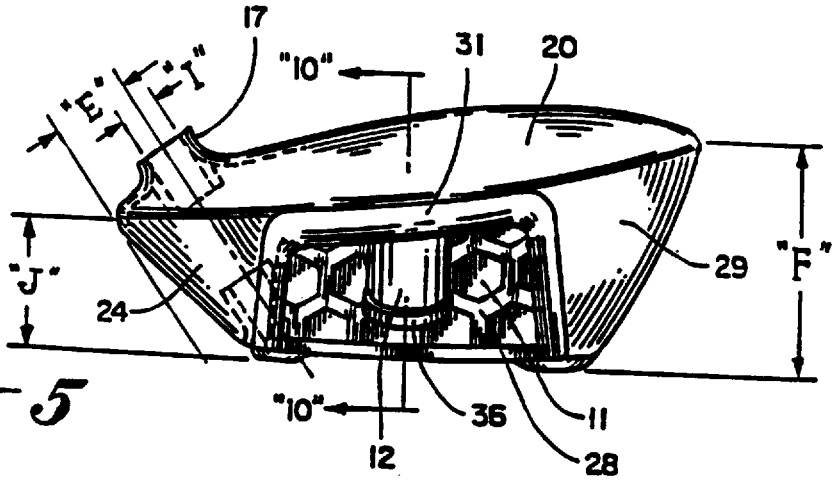
FIG. 5 is a rear view of the club head illustrated in FIGS. 1 to 4.

As seen in FIG. 3, a toe wall 29, formed integrally with front wall 14 and top wall 20, wraps around the top wall 20 and connects with the heel wall 24 with a narrow downwardly depending rear portion 31 shown in FIG. 5, that is integral with top wall 20.

Figure 8:
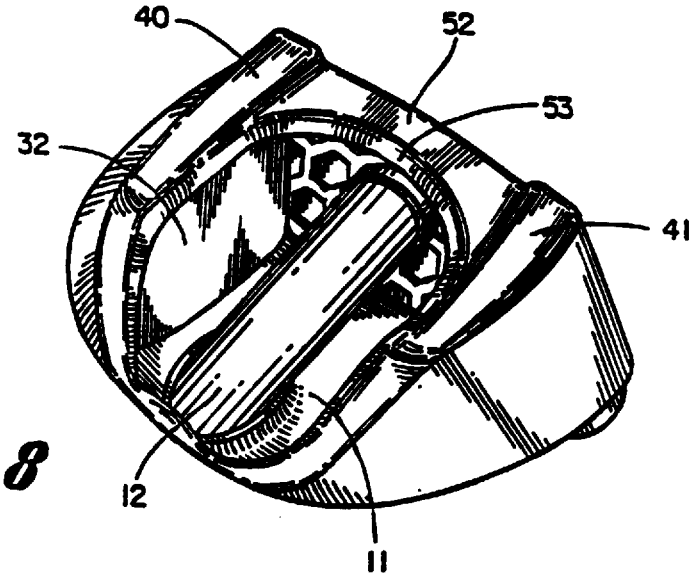
FIG. 8 is a bottom perspective of the club head illustrated in FIGS. 1 to 7.
Figure 9:
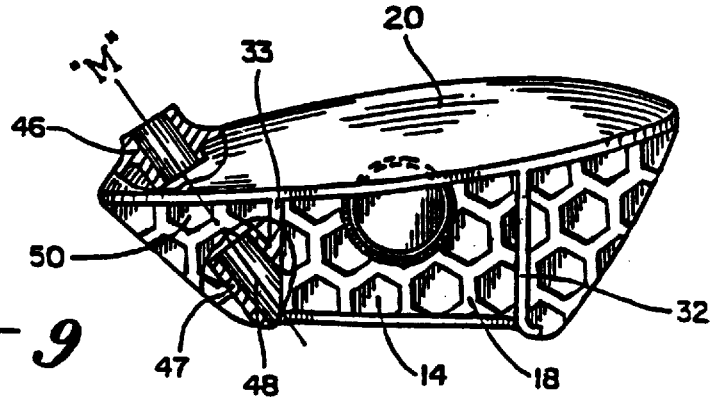
FIG. 9 is a rear view of a sub-assembly of the club head illustrated in FIGS. 1 to 8 with portions of its hosel shown in fragmented section.
Figure 10:
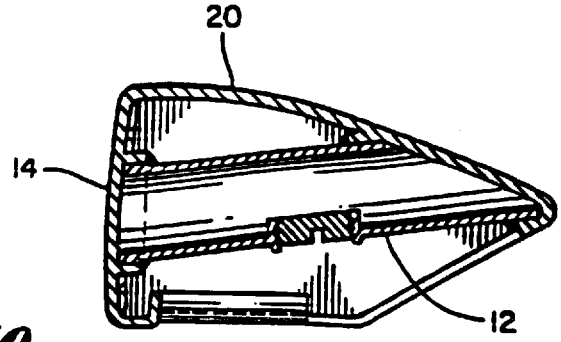
FIG. 10 is a longitudinal section through the club head according to the present invention taken generally along line 10—10 of FIG. 5.
Figure 11:
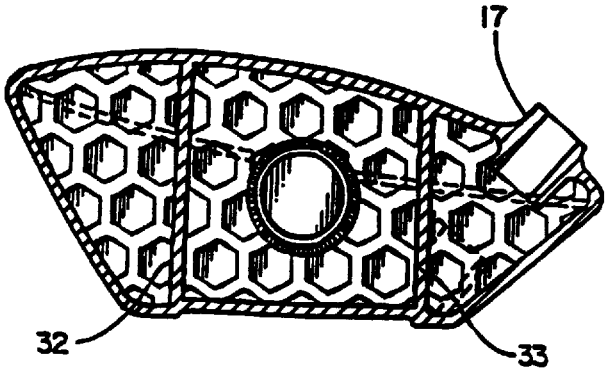
FIG. 11 is a cross-section of the club head illustrated in FIGS. 1–10 taken generally along line 11—11 of FIG. 2.

As seen in FIGS. 8 and 9, a toe weight wall 32 is formed integrally with face wall 14 and top wall 20 and a heel weight wall 33 is formed integrally with the front wall 14 and the top wall 20. Toe weight wall 32 is also integrally formed with toe wall 29 while heel weight wall 33 is also formed integrally with the heel wall 24, thereby defining hollow toe chambers and heel chambers similar to that described in my U.S. Pat. No. 5,397,126.

The rear surface of the face wall has an integral honeycomb structure 18 that reinforces and permits the face wall to be formed considerably thinner than normal.

As seen in FIG. 1, the lateral total length of the club head 10 in a direction perpendicular to the target line is the dimension A, which according to the present invention, ranges from 4.063 in. to 4.47 in. The face wall height dimension G in FIG. 3, is 1.563 in. to 1.720 in. The total face height shown also in FIG. 3 and designated B, is 1.600 in. to 1.758 in. The rear club head height D, also shown in FIG. 3, ranges according to the present invention from 0.750 in. to 0.825 in. The height of the toe wall designated F in FIG. 5, ranges from 1.500 in. to 1.650 in., according to the present invention. The height of the toe wall 24 designated J, ranges from 0.875 to 0.963.

Also as seen in FIG. 5, the dimension E, which is the perpendicular distance from the axis of the hosel 17 to the furthest projection of the heel of the club head, ranges according to the present invention, from 0.563 in. to 0.625 in. The inside diameter of the hosel 17 is 0.334 in.

Figure 6:
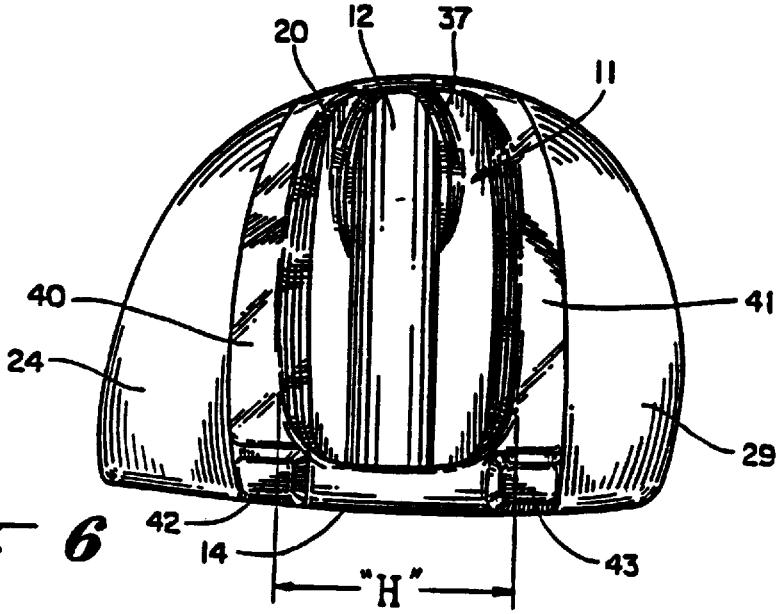
FIG. 6 is a bottom view of the club head illustrated in FIGS. 1 to 5.

As seen in FIG. 6, the lateral width H of the cavity 11 in the bottom of the present club head, is 1.625 in.

As seen in FIGS. 5, 6 and 8, a ring 36 is formed integrally with the forward face wall 14 and has an axis coincident with the axis of the power shaft 12. The inside wall of the ring 36 is tapered rearwardly outwardly at a 3 degree angle. A second ring 37, elliptical in configuration, is formed integrally on the lower rear surface of the top wall 20 and also has an axis coincident with the axis of the power shaft 12.

An important aspect of the present invention is that the power shaft 12 is integral with the integral ring 36 at its forward end and with the rear ring 37 at its rear end, which is essential to achieving not only club head integrity but to achieve the desired increase in resonant frequency of the front face 12, as well as the desired rebound characteristic of the front face. To achieve this the shaft 12 may be cast with either the face wall or the rear portion of the club head and then either press fitted or welded to the other part. Or the shaft can be welded, in some cases, to both.

As seen in FIG. 6, the heel wall 24 and the toe wall 29 have bottom rails 40 and 41 formed therein that serve to set the club head up in its proper orientation when lying on the ground. Rails 40 and 41 have pads 42 and 43 respectively at their forward ends that provide the set-up for the adjacent club head front wall 14. It should be understood that the volume of the present club head; i.e., on the order of 250–300 cc. is the outside volume of the club head including the volume of the open area 11. That is, the volume definition assumes that the open area is enclosed as opposed to being open as shown in the drawings. Furthermore in this regard, it should be noted that the mounting and assembly of power shaft 12 is adaptable to club heads that have completely enclosed sole plates as opposed to the partly open sole plate arrangement of the club head 10 illustrated in the present drawings.

An important aspect of the present invention and as shown more clearly in the sub-assembly illustrated in FIG. 9, is that the hosel 17 includes a first annular portion 46 formed in the top wall 20 and a second lower annular portion 47, which is formed integrally with the heel weight wall 33. It should also be understood that the lower annular portion 47 could also be formed in the heel wall 24 or in the sole plate of clubs with fully formed sole plates. The annular portions 46 and 47, since they are spaced apart, have significantly less weight than present day hosel configurations. It should also be understood that lower annular portion 47 has a through-bore 48 therethrough that opens to the lower part of the club permitting the club shaft to be extended completely therethrough during assembly.

During assembly, adhesive is applied to the club shaft and its tip inserted in both bosses 46 and 47 projecting slightly downwardly from the boss 47. The adhesive or bonding agent, usually epoxy, is extended, prior to insertion, over a sufficient length of the tip end of the shaft and the shaft is rotated as it is inserted into the bosses so that epoxy covers the shaft between the upper boss 46 and the lower boss 47 and attaches to these bosses forming a sleeve 50 around the shaft attached to both of the bosses. In essence, this defines a continuous hosel portion of rigid, hard epoxy between the upper boss 46 and the lower boss 47 of significantly reduced weight without sacrificing any structural integrity. The wide spacing between the upper annular boss 46 and the lower annular boss 47 provides less concentrated club shaft torquing than the designer normally finds in the relatively short hosels found in present day metal woods.

Figure 7:
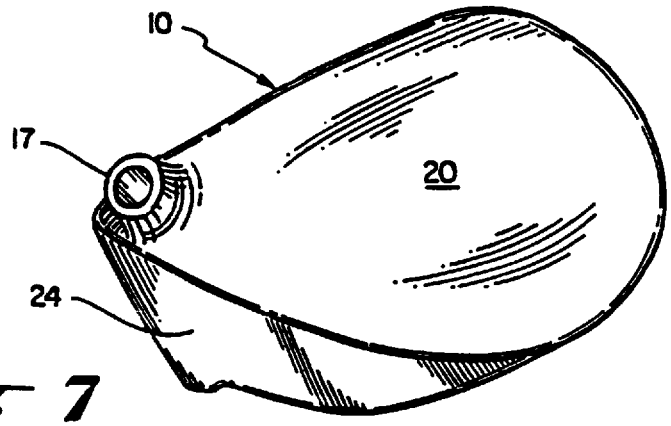
FIG. 7 is a rear perspective of the club head illustrated in FIGS. 1 to 6.

As seen in FIG. 7, a short forward wall 52 is formed integrally with and extends rearwardly from the lower part of the club face 14 between rails 40 and 41, and it has an upwardly extending or arcuate flange 43 that provides an "I" beam or "T" beam effect with portion 52 to support the front club face.

Figure 12:
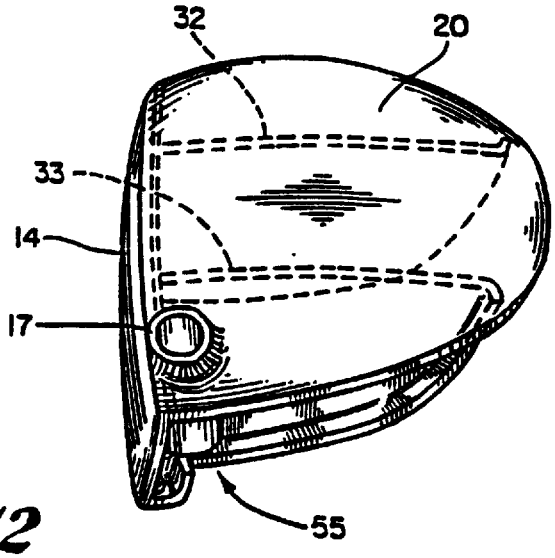
FIG. 12 is a right side top perspective view of the club head sub-assembly illustrated in FIG. 9.
Figure 13:
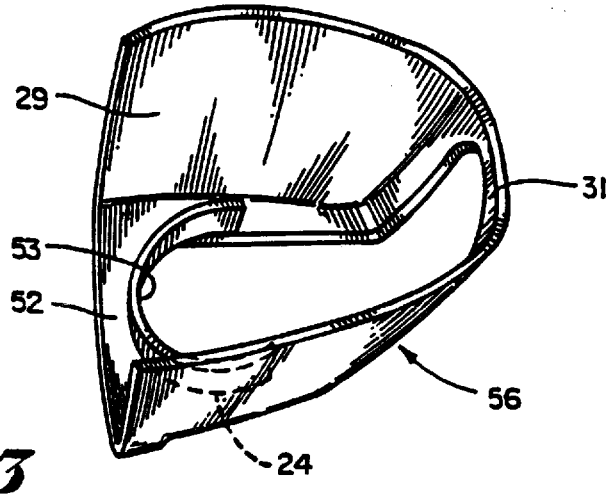
FIG. 13 is a top perspective of a rear portion sub-assembly of the club head illustrated in FIGS. 1 to 8.

As seen in FIGS. 12 and 13, one embodiment of the club head 10 can be manufactured in two parts; namely, a forward part 55 and a rear part 56. The forward part 55 includes front wall 14, top wall 20, hosel 17, toe weight wall 32, and heel weight wall 33. The rear portion 56 includes toe weight wall 29, connecting portion 31, heel weight wall 24, bottom wall portion 52, and flange 53. Castings or forgings 55 and 56 are joined together by known welding techniques. It should be understood, however, that the preferred casting and assembly techniques for the present invention are illustrated in FIGS. 19, 20 and 21, as will appear more clearly hereinafter.

Figure 14:
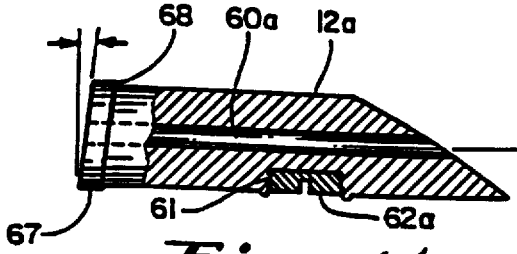
FIGS. 14 to 18 are four power shafts according to the present invention, each providing a different resonant frequency.
Figure 15:
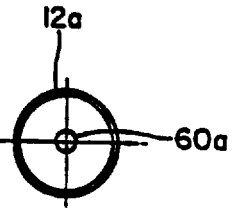
Figure 16:
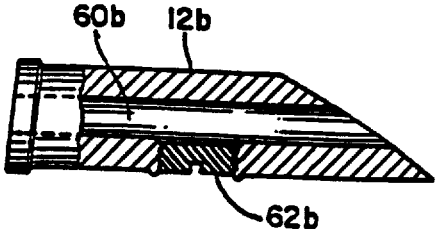
Figure 17:
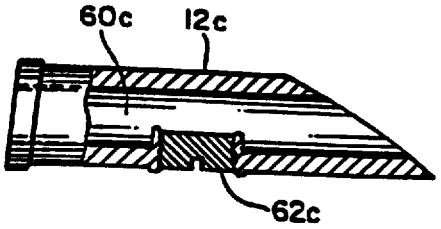
Figure 18:
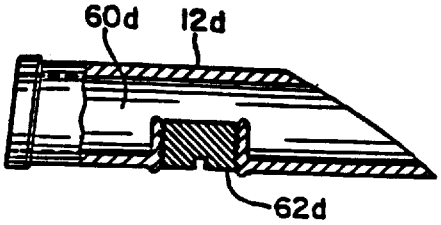

As discussed above, the power shafts, according to one embodiment of the present invention, shown as 12*a*, 12*b*, 12*c* and 12*d*, in FIGS. 14 to 18, match the rebound and a resonant frequency to the swing speed of the golfer. The power shaft 12*a* illustrated in FIGS. 14 and 15, is designed for the high swing speed golfer, on the order of 100 to 125 mph (ft/sec). The power shaft 12*b*, in FIG. 16, is designed for the 85 to 100 mph swing speed golfer; the power shaft 12*c* in FIG. 17 is designed for the 70 to 85 mph swing speed golfer, and the power shaft 12*d* in FIG. 18 is designed for the golfer having a swing speed below 70 mph (below×ft/sec). Each of the power shafts 12*a* to 12*d* has the same weight, and the power shafts 12*a* to 12*d* are all of equal weight. In a 190 to 205 gms. high titanium alloy head, the power shafts are all about 50 gms., or approximately 25% of the total club head weight. In stainless, the power shafts are 20 gms. or about 10% of total head weight. The power shafts 12*a* to 12*d* have increasing inside diameters in through passages 60*a*, 60*b*, 60*c* and 60*d* so that the power shafts provide increasing higher rigidity, increasingly higher modulus and increasingly faster rebound to the front face as one moves from power shaft 12*d* to power shaft 12*a*. To maintain the total overall weight of each of the power shafts the same, and hence, the overall weight of the club head is approximately the same, for all golfers, an annular threaded boss 61 is provided transverse to or radial to the passages 60 in each of the power shafts into which a cylindrical weight 62*a*, 62*b*, 62*c*, or 62*e* is threaded, each having progressively increasing axial length and weights to compensate for the loss of weight caused by the increasing diameter of the through passages 60*a*–60*d*. An integral annular ring 67 is provided on the forward end of each of the power shafts to seat neatly within the forward ring 36. Annular portion 67 has a depth approximately equal to forward ring 36 providing a shoulder 68 that increases the service area for weldment location between the annular ring 67 and the annular ring 36. Ring 67 has a 3 degree inwardly forwardly tapered outer surface so the shaft can be press fitted into ring 36 which has the same taper on its inner surface. Press fitting can eliminate the need for welding the shafts to the club head. A similar annular portion could be provided at the rear end of the shafts 12*a* to facilitate welding to rear ring 37 but are not shown in the drawings.

Figure 19:
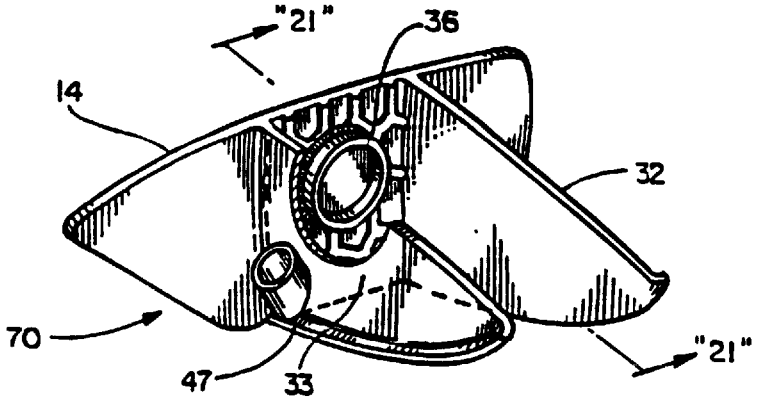
FIG. 19 is a rear perspective of a forward sub-assembly of the club head illustrated in FIGS. 1 to 8 constructed differently than the sub-assemblies illustrated in FIGS. 9, 12 and 13.
Figure 20:
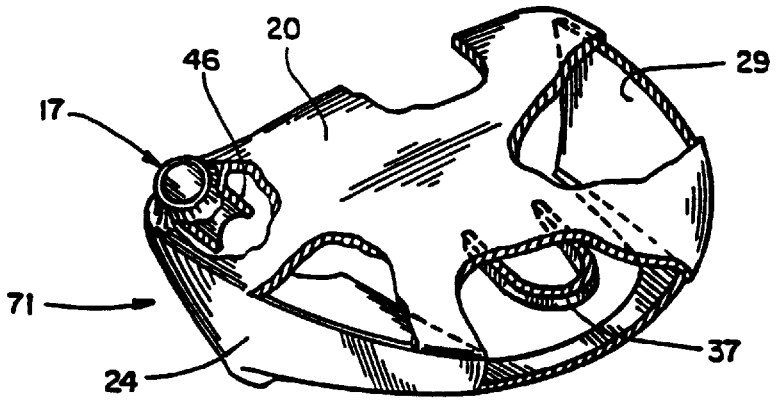
FIG. 20 is a rear perspective of a club head rear portion that mates with the forward club head sub-assembly illustrated in FIG. 19.
Figure 21:
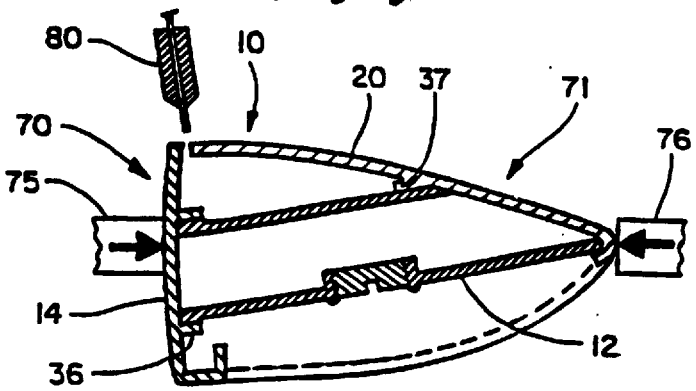
FIG. 21 is a longitudinal section of the sub-assemblies illustrated in FIGS. 19 and 20 taken generally along line 21—21 of FIG. 19.

A preferred method of manufacturing the present invention is illustrated in FIGS. 19, 20 and 21, and this method is particularly directed to facilitating the insertion of the shaft 12 into the club head assembly and to pre-loading the shaft 12 against the front face 14.

The club head 10 is constructed according to FIGS. 19, 20 and 21, in two pieces. The first being the forward piece 70 containing the forward ring 36, and the rear piece 71 containing the rear ring 37. The forward piece 70, which may be cast preferably by investment casting and preferably utilizing the light-weight high surface hardness alloys discussed above, includes the forward face 14, the honeycomb face reinforcement 18, the integral ring 36, the heel weight wall 37 with its annular hosel boss 47 integrally formed therewith, and forward wall 32.

The rear club head portion 71 is an integral casting including top wall 20, hosel upper boss 46, rear ring 37 integrally formed underneath the rear portion of top wall 20, toe wall 29, heel wall 24, and a connecting wall portion.

After rough finishing the two castings 70 and 71, they are placed in a jig including a forward component jig 75, and a rear component jig 76 that firstly hold respectively the forward portion 70 of the club head and the rear portion 71 of the club head, and at the same time direct the two portions toward one another. Shaft 12 is inserted into forward ring 36 and rear ring 37 prior to placement into jig 75, 76. After placement into the jig, the jig moves the forward portion 70 in the direction of rear portion 71. Thereafter, a program welding system 80 welds the front portion 70 to the rear portion 71 connecting the parts together.

Reference will now be made to the embodiments of the present invention shown and described with reference to FIGS. 22 to 35. These embodiments are generally similar to the power shafted embodiments shown and described above with reference to FIGS. 1 to 21 with several distinctions that can be gleaned from reviewing FIGS. 21 to 35, and these include an enclosed, rather than completely open, bottom cavity, a uniform wall thickness power shaft, a non-welded power shaft, variable power shaft preload matched to swing speed, and an improved method of manufacture and assembly.

It should be understood that application (not patent) FIGS. 24 to 32 are drawn to scale so that while certain specific dimensions described below are referenced to FIGS. 24 to 32, that other dimensions may be measured on a 1 cm.=1 cm. scale on these Figures to arrive at other club head dimensions not specifically noted herein.

The club head 110 illustrated in FIGS. 22 to 32 is preferably constructed of a titanium alloy such as 6AV4, which signifies a high titanium alloy of 6% aluminum, 4% vanadium, and the balance pure titanium. The club head 110 has a volume of 280 $cm.^3$ (compared to the 260 $cm^3$ volume of club head 10), and a ball striking face area of 43.25 $cm.^3$. The principles of the present invention, at least certain aspects of the present invention, are applicable to jumbo "wood" type club heads having total volumes in the range of 220 to over 300 $cm.^3$, as well as face areas in the range of 32 to 45 $cm.^3$.

Figure 28:
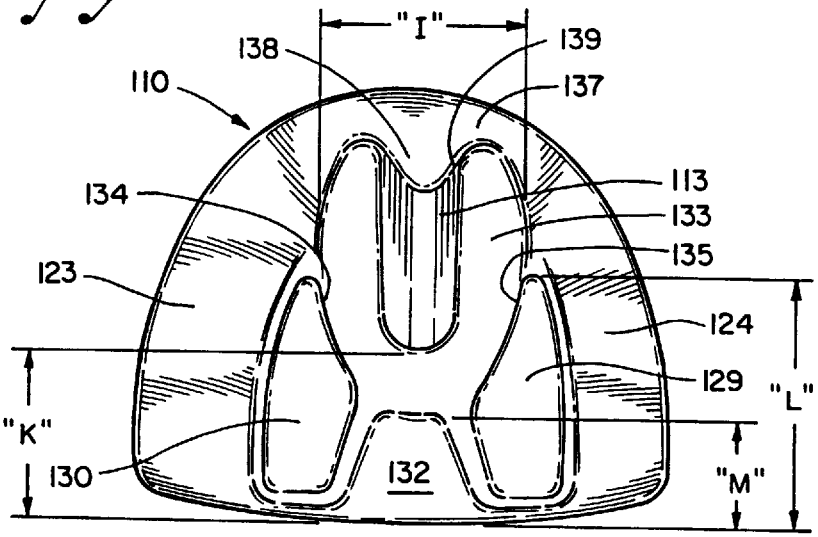
FIG. 28 is a bottom view of the club head illustrated in FIGS. 24 to 27.
Figure 29:
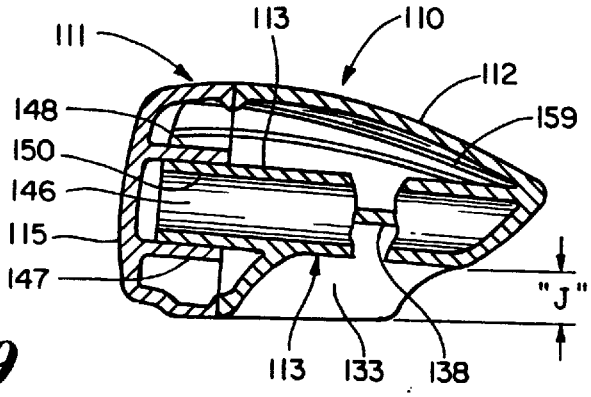
FIG. 29 is a longitudinal section of the club head illustrated in FIGS. 24 to 28 taken in a vertical plane along the target line through the geometric center of the face shown in FIGS. 24.
Figure 35:
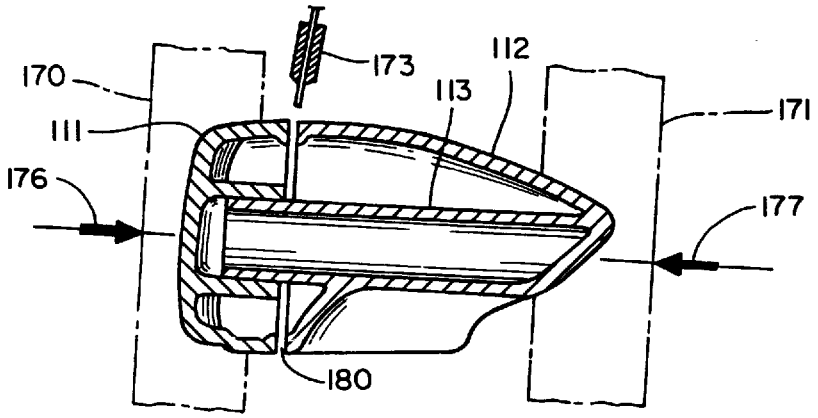
FIG. 35 is an illustration of the method of assembly of the club head illustrated in FIGS. 22 to 32.

The club head 110 illustrated in FIGS. 22 to 32 is constructed of three pieces that are joined together in assembly; namely, a club head forward portion 111 illustrated in FIG. 31, a club head rear portion 112 illustrated in FIG. 32, and a power shaft 113 shown in FIGS. 29 and 35. While the power shaft 113 is shown integral with club head rear portion 112 in FIG. 29, the power shaft 113 is cast separately from the rear portion, attached to the rear portion by welding or press-fitting it therein in a manner similar to the press-fit illustrated in FIG. 29 at the forward end of the power shaft 113 joining it to the club head forward portion 111.

Viewing FIGS. 24 to 32, the club head 110 is seen to generally include a grooved ball striking face wall 115 having an area of 43.25 cm.$^3$, and a wall thickness as viewed in the plane of FIGS. 29 and 30 of about 3.3 mm. In this regard, the wall thicknesses throughout the club head 110 are in the range of 2 to 3 mm. except for the face wall 115, which is somewhat thicker. A crowned top wall 117 extends integrally and rearwardly from the upper portion of the face wall 115, and it has a short integral hosel segment 118 projecting upwardly therefrom with a shaft receiving bore 119 therein that extends through spaced hosel segments 120 and 121 illustrated in FIG. 31.

Figure 24:
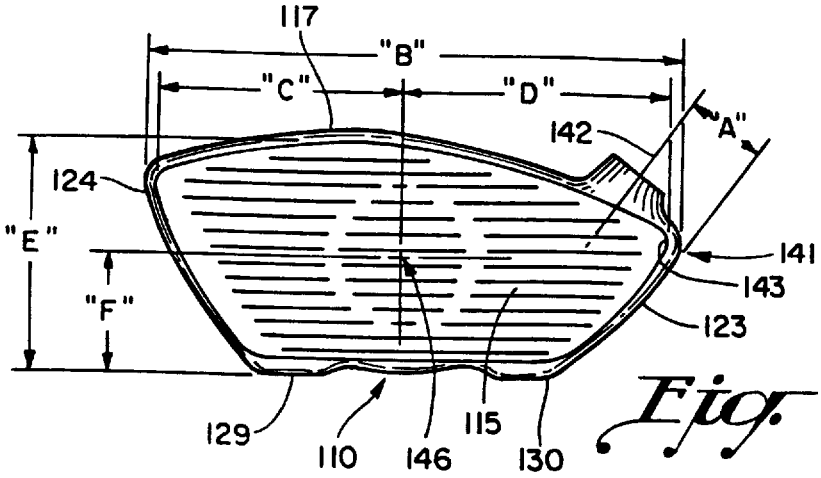
FIG. 24 is a 1:1 scale front view of the club head embodiment illustrated in FIGS. 22 and 23.

A heel wall 123 is integral with and extends in an arcuate path rearwardly from the right side of the face wall 115 as viewed in FIG. 24. A toe wall 124 is formed integrally with the face wall 115 and extends rearwardly in an arcuate path from the extreme toe end of the face wall 115 and is also integrally formed with the top wall 117, as is the heel wall 123.

Figure 22:
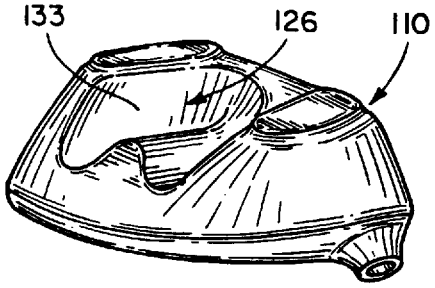
FIG. 22 is a right rear perspective of another embodiment of the present golf club head with power shaft.
Figure 23:
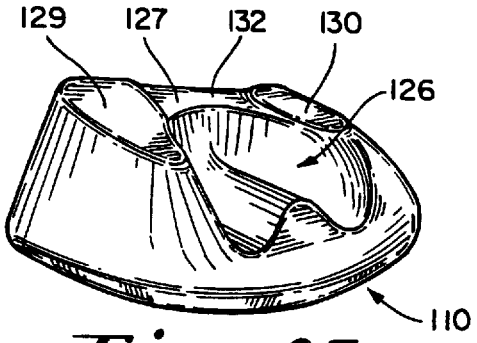
FIG. 23 is a left rear perspective of the golf club head illustrated in FIG. 22.

As seen in FIGS. 22 and 23, there is a cavity 126 formed in the bottom of the club head 110 that exposes the rear of the power shaft 113. Cavity 126 is defined by a sole plate 127 that is not a separate piece but formed by the forward and rear portions of the club head sub-assemblies illustrated in FIGS. 31 and 32. Sole plate 127 has a toe rail 129 and a heel rail 130 (see FIGS. 22, 23 and 29) that are coplanar as seen when comparing FIGS. 26 and 27 and provide the setup geometry for the club head; i.e., face angle(open-closed), face loft, club head lie, etc. The forward sole plate portion 132 is recessed upwardly from the plane of the setup rails 129 and 130 and is arcuate when viewed from the bottom of the club head. Sole plate portion 132 connects with an integral upwardly extending semi-spheroidal wall 133 that defines the cavity 126 and extends upwardly from the arcuate rear ends 134 and 135 (FIG. 28) of the set up rails 130 and 129 respectively.

As seen in FIG. 30, semi-spheroidal wall 133 is formed entirely in club head rear sub-assembly 112.

The heel wall 123 and the toe wall 124 smoothly connect tangentially with a club head rear wall 137 that has a semi-ellipsoidal segment 138 welded to and enclosing the rear end of the power shaft 113 along mating line 139.

As seen in FIG. 29, the upper portion 138 of the spheroidal cavity wall 133 runs along a line parallel to the power shaft 113 and is integral with or welded to the sides of the power shaft 113 to increase the modulus of elasticity of the power shaft in the columnar or axial direction.

Figure 25:
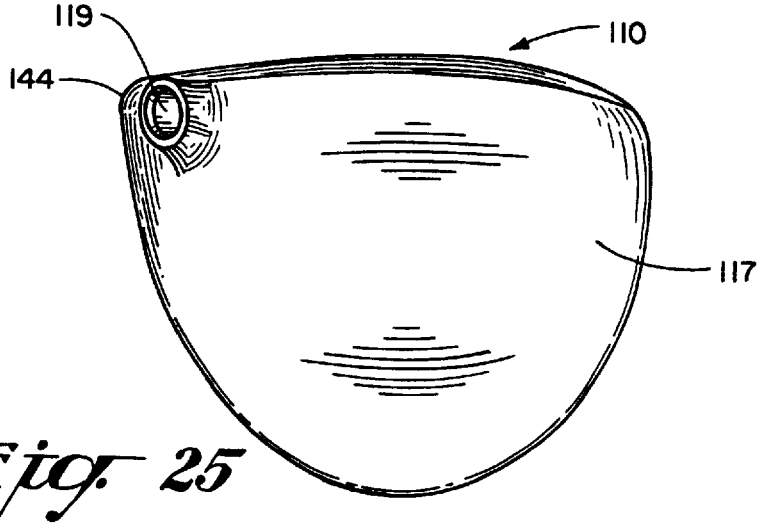
FIG. 25 is a scaled top view of the club head illustrated in FIG. 24.

As seen in FIGS. 24 and 25, the club head 110 has a somewhat pointed heel 141 that projects outwardly from the hosel 118 in a direction perpendicular to the axis of the hosel a distance of 15.8 mm. This dimension is taken from the furthest extent of the heel when viewed in the plane of FIG. 24, which is somewhat further from hosel axis 142 than the furthest extent 143 of the face wall 115 because of the radius 144 of the heel wall 123 as seen in FIG. 25. This relationship conforms with the Rules of the USGA.

Viewing FIG. 24, the total heel to toe length of the club head 110, dimension B, is 110 mm., while the total heel to toe length of face wall 115 (C+D) in a horizontal direction is somewhat less, about 105 mm. The furthest toe extension on the face wall from a vertical plane containing geometric center 146, dimension C in FIG. 24 is 48 mm., while the furthest extent of the face wall from the heel to the vertical plane of point 146, dimension D, is 57 mm. Maximum face wall height, dimension E, is 48 mm. and geometric center point 146 is spaced a distance of 25 mm. (F) from the ground.

Figure 26:
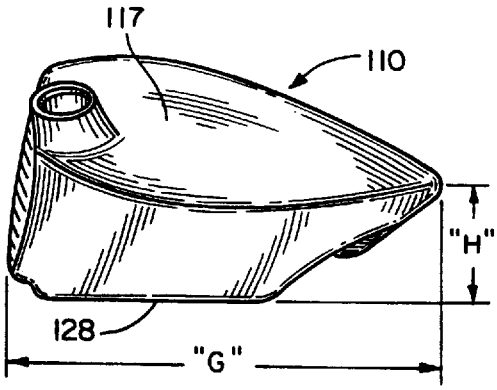
FIG. 26 is a right side view of the club head illustrated in FIGS. 24 and 25.
Figure 27:
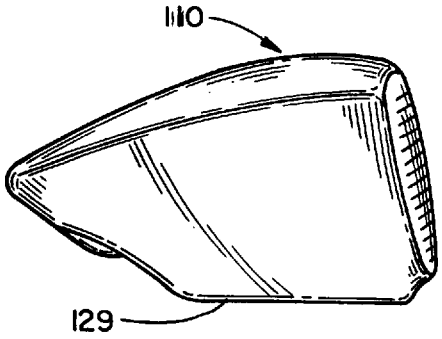
FIG. 27 is a left side view of the club head illustrated in FIGS. 24 to 26.

Viewing FIG. 26, total club head length from the lower leading edge of the club face, dimension G. is 90 mm., while the rear end of the top wall 117, dimension H. is 24 mm. off the ground, and the lower rear end of the power tube 113 is 9.5 mm. off the ground (J in FIG. 29)

Viewing FIG. 28, the forward-most exposed portion of the power tube 118, from the lower leading edge of the face wall 115 (dimension K) is 36 mm., while the rear end of the set-up rails 129 are spaced a distance L from the lower leading edge of the face wall of 54 mm., and the forward portion of the sole plate portion 132 is spaced 22 mm. from the face wall leading edge identified by the letter M in FIG. 28.

Viewing FIG. 31, upper hosel segment 120 has an axial length N of 14 mm., while lower hosel segment 121 has an axial extent P of 12 mm. Distance Q is the horizontal distance from geometric center 146 to the furthest toe extent of the rear portion casting 117, and that value is 50 mm.

The power shaft 113 has an outer diameter of 13 mm. and a wall thickness of 0.8 mm., although shown heavier in the drawings and that is an exception to the above delineated scale of the drawings.

As seen in FIG. 29, the forward end 146 of the power shaft 113 has a frusto-conical portion 147 that tapers forwardly at a 3 degree angle and is press-fitted into a socket 148, which is annular in configuration and integrally cast with the face wall 115. Socket 148 has a frustoconical inner surface 150, also at a 3 degree taper, that receives the tapered forward end 146 of the power shaft 113.

The power shaft 113 performs several functions according to the present invention. It rigidifies the face wall 115, but more importantly, increases the effective modulus of elasticity of the face wall. Power shaft 113 also decreases the rebound time of the face wall 115 after its deformation during ball impact. It does this in a manner so that the face wall 115 rebounds while the ball is still in engagement with the face wall to increase the exit velocity of the ball as it leaves the face wall.

These functions are in part effected by preloading the power shaft 113 against the face wall 115 to various values depending upon the swing speed of the golfer. For the slower swing speed golfer in the range of 20 to 80 mph (32 to 129 kilometers per hour), the power shaft is preloaded to a value of about 40 kg. In the intermediate swing speed club head, according to the present invention, in the range of 80 to 100 mph (129 to 161 kilometers per hour), shaft 113 is preloaded to a value of about 70 kg., and for the fast swing speed golfer, in the range of over 100 mph (161 kilometers per hour), power shaft 113 is preloaded to a value of about 100 kg.

An important aspect of the present invention is the ability of the club face 115, the top wall 110, the heel wall 123, and the toe wall 124, to resist and hold the high preloads on the power shaft 113, which in effect places all of these walls in tension. This ability is significantly enhanced by the ribbing of the face wall, the top wall, the toe wall, and the heel wall illustrated in FIGS. 29, 30 and 32. Viewing FIG. 31, face wall 115 has integral reinforcing ribs 152, 153, 154 and 155 extending outwardly from and integral with the annular socket 148. Ribs 152 and 154 extend generally horizontally while ribs 153 and 155 extend generally vertically. Rib 152 connects with and is integral with rib 157 that is integral with and approximately midway up the heel wall 123. As seen in FIG. 32, rib 157 extends all the way to the rear end of the heel wall 123. Rib 153 connects with and is integral with top wall rib 159 that extends centrally in the top wall 117 and rearwardly to the rear end of the top of the power shaft 113 as seen in FIG. 29.

Face wall rib 154 connects with and is integral with toe wall rib 161 that extends rearwardly and generally centrally in the toe wall 124 to the rear end of the club head, as seen in FIG. 32. The top wall has additional ribs 162 and 163 that also extend to the rear end of the top wall 117.

The power shaft 113 tends to increase the roll and bulge or convexity of the face wall 115, and the ribs 152, 153, 154 and 155 resist this bulging tendency and permit the face wall 115 to be constructed considerably thinner than required to resist the high preloading forces. Since ribs 152, 153, and 154 are integral with the heel wall, top wall and toe wall ribs 157, 159 and 151, they in essence provide a hoop-type structure that resists the front to rear tension forces in these walls caused by power shaft preloading.

All of these ribs have a width slightly over 3 mm. and a thickness (their extension from the inner surface of the walls from which they project) of about 2 mm.

As seen in FIGS. 29 and 30, the parting line between the forward portion 111 and the rear portion 112, which are separate castings, is about 21.5 mm. from the lower leading edge of the face wall 115 in a rearward direction along a vertical plane extending along the target line through point 146.

Press-fitting the forward end of the power shaft 113 into the socket 148 has several advantages. The foremost is the strength of the union between the shaft and the face wall equals the highest quality weld. Next, it eliminates possible part deformation caused by welding the power shaft to the front face 115, and it also enables the power shaft to be joined to the face wall at a time when the interior hollow cavity of the club head is enclosed by the toe wall, heel wall, top wall and sole wall, which otherwise would prevent access to this area.

A socket similar to socket 148 can be provided in the rear of the club head to receive the rear end of the power shaft 113 to eliminate welding the power shaft 113 to the rear end of the club. However, minor heat distortion caused by welding the rear end of the club to the rear wall of the club is not a significant problem compared to welding the forward end of the tube to the face wall where even minor distortions of the face wall are significant.

In manufacture, the club head forward casting 111 is joined to the club head rear casting 112 along their parting lines after the power shaft 113 is clamshelled there-between as seen in FIG. 35. The forward piece 111 is held in position by a jig 170 with a cavity complementing the outer surfaces of casting 112, and the rear club head casting 112 is held in position by a jig 171 having a cavity corresponding to the outer rear configuration of club head casting 112. An axial force is applied to the jigs 170, 171 by a vise represented by force arrows 176 and 177 in FIG. 35.

The axial lengths of the castings 111 and 112 and the power shaft 113 are selected so that a slight gap 180 remains between the casting 111, 112 at each of the preloads. This requires the ends of the castings to be ground to achieve this result with all four preloads. The preload applied by the vise forces 176 and 177 is actually about 20% higher than the final preload due to weld relaxation, as well as top wall, toe wall and heel wall tensioning as the club head is removed from the vise. More specifically, the vise's preload on the castings 111 and 112 should be about 20% higher than the final desired preload in power shaft 113. After this value preload has been applied by the vise, an automatic welding tool 173 runs a bead along the parting line between castings 111 and 112, completing the assembly. It is important to note that the resulting weld should be permitted to cool substantially after welding to minimize the loss of preload caused by weld relaxation at an elevated temperature.

A further embodiment of the present invention is illustrated in FIGS. 33 and 34, wherein a club head 190 is illustrated generally of the same configuration as the club head 110 in connection with FIGS. 22 to 32, except for the manner of adjusting the preload. The club head 110 includes a forward portion 191 and a rear portion 192 joined together by welding along parting line 196. Power shaft 193 is press-fitted into a socket similar to socket in forward portion 191, but it has a piston 194 fastened into its rear end that slides in a cylinder 197 in the rear casting 192. Rear casting 192 has a rear integral vertical wall 198 that receives a threaded screw 199 that engages the rear surface of the piston 194 to adjust the preload on the power shaft 193. An advantage in this design is that it eliminates the preload losses caused by weld relaxation and wall tensioning in the FIG. 35 method. The area behind screw 199 is covered by a disc 200 after the manufacturer sets the preload to prevent customer or club maker variation of the preload set by the manufacturer.

I claim:

1. An enlarged golf club head constructed of lightweight material, comprising: a golf club head including a body having a ball striking face wall, a rearwardly extending top wall and a hosel in the body, said body having a volume of at least about 240 cc. constructed of lightweight material with a modulus of elasticity less than steel alloys, and means to increase the modulus of elasticity of the face wall to a value at least approximating that of steel alloys without increasing club head weight, including a power shaft in the body integral with the face wall and having a sufficient preload on the face wall to achieve the above values, said face wall having a tapered socket integral therewith, said power shaft having a complementary taper engaging the tapered socket and pressed therein sufficiently to achieve the preload value.

2. An enlarged golf club head constructed of lightweight material, comprising: a golf club head including a body having a ball striking face wall, a rearwardly extending top wall and a hosel in the body, said body having a volume of at least about 240 cc. constructed of lightweight material with a modulus of elasticity less than steel alloys, and means to increase the modulus of elasticity of the face wall during assembly to a fixed non-adjustable after assembly value at least approximating that of steel alloys without increasing club head weight, including a power shaft in the body integral with the face wall and having a sufficient preload on the face wall to achieve the above values, said body being formed by a forward portion including the face wall and a portion of the top wall, and a rear portion including a portion of the top wall, said forward portion and rear portion being joined together by welding, said power shaft being constructed of a piece separate from the forward portion and rear portion and clamshelled in between during assembly.

3. An enlarged golf club head constructed of lightweight material, comprising: a golf club head including a body having a ball striking wall, a rearwardly extending top wall and a hosel in the body, said body having a volume of at least about 240 cc. constructed of lightweight material with a modulus of elasticity less than steel alloys, and means to reduce the rebound time of the face wall to a value to begin rebound before the ball exits the club head face wall including a power shaft in the body integral with the face and having a sufficient preload on the face wall to reduce the rebound time of the face wall to said value, said face wall having a tapered socket integral therewith, said power shaft having a complementary taper engaging the tapered socket and pressed therein sufficiently to achieve the preload value.

4. An enlarged golf club head constructed of lightweight material, comprising: a golf club head including a body having a ball striking wall, a rearwardly extending top wall and a hosel in the body, said body having a volume of at least about 240 cc. constructed of lightweight material with a modulus of elasticity less than steel alloys, and means to reduce the rebound time of the face wall during assembly to a value to begin rebound before the ball exits the club head face wall including a power shaft in the body integral with the face and having a sufficient preload on the face wall to reduce the rebound time of the face wall to said value which is fixed and nonadjustable after assembly, said body being formed by a forward portion including the face wall and a portion of the top wall, and a rear portion including a portion of the top wall, said forward portion and rear portion being joined together by welding, said power tube being constructed of a piece separate from the forward portion and rear portion and clamshelled in between during assembly.

5. A single line of golf clubs including a plurality of clubs including at least one high swing speed club and at least one low swing speed club each with a club head of the same size and outer shape and a shaft with each club in the line specific to a golfer with a specific swing speed range, comprising: a plurality of club heads having the same size and outer shape having a shaft, each of the club heads including a body having a face wall and a rearwardly extending top wall and a hosel in the body, each of the club heads having one of a plurality of power shafts therein integral with the face wall, and means for changing the modulus of elasticity of the face wall from one club in the line to another club in the line including means to preload the power shaft against the face wall, and means to provide a high swing speed club in the line including one of the club heads having a predetermined fixed non-adjustable after assembly high preload with the same size and outer shape and means to provide a low swing speed club in the line including one of the club heads having a predetermined fixed non-adjustable after assembly lower preload with the same size and outer shape.

6. A line of golf clubs as defined in claim 5, wherein there are more than two clubs in the line and at least four each with increasing preload from the low swing speed club to the high swing speed club.

7. A line of golf clubs as defined in claim 5, wherein the high swing speed preload is in the range of about 80 to 100 kg. and the low swing speed preload is in the range of about 40 to 80 kg.

8. A line of golf clubs as defined in claim 5, wherein each of the club heads has a volume of at least 240 $cm.^3$, and is constructed of a material substantially lighter than steel alloys.

9. A line of golf clubs as defined in claim 5, wherein the club head is constructed of titanium and the power shaft is constructed of titanium.

10. A line of golf clubs as defined in claim 5, wherein the power shaft is a tube press-fitted into the face wall.

11. A line of golf clubs as defined in claim 5, wherein the power shaft is press-fitted at least at one end thereof into the body, said body having a sole plate that encloses the power shaft in the body and prevents access to the power shaft in the body after the sole plate is attached to the body.

12. A line of golf clubs as defined in claim 5, wherein the face wall has a ball striking face area of at least 30 $cm^2$.

13. A line of golf clubs as defined in claim 5, wherein the face wall has a ball striking face area in the range of about 30 $cm^2$ to 45 $cm^2$.

14. A line of golf clubs as defined in claim 5, wherein the face wall has a height of at least 40 mm.

15. A single line of golf clubs including a plurality of clubs each with a club head of the same size and outer shape and a shaft with each club in the line specific to a golfer with a specific swing speed range, comprising: a plurality of club heads having the same size and outer shape having a shaft, each of the club heads including a body having a face wall and a rearwardly extending top wall and a hosel in the body, each of the club heads having one of a plurality of power shafts therein integral with the face wall, and means to increase the modulus of elasticity of the face wall including means to preload the power shaft against the face wall, and means to provide a high swing speed club in the line including one of the club heads having a predetermined fixed high preload with the same size and outer shape and means to provide a low swing speed club in the line including one of the club heads having a predetermined fixed lower preload with the same size and outer shape, said face wall having a tapered socket integral therewith, said power shaft having a complementary taper engaging the tapered socket and pressed therein sufficiently to achieve the preload value.

16. A golf club head, comprising: a body having a face wall and a top wall, a hosel in the body, a power shaft for rigidifying the face wall including a press-fit connection between the power shaft and the face wall to eliminate the need for welding the power shaft to the face wall, said body being formed in a forward portion and rear portion and the power shaft is clamshelled in between, said power shaft being formed separately from the forward and rear portions and thereafter assembled thereto, said press-fit connection including a tapered socket integral with the face wall and a tapered end on the power shaft engaging the tapered socket.

17. A golf club head as defined in claim 16, wherein the body includes a bottom wall or sole plate wall that encloses the power shaft and prevents access to the power shaft after the sole plate wall is in position.

18. A golf club head with a rigidified forward face wall, comprising: a club head body having a forward portion and separately made mating rear portion, said forward portion including a face wall and a portion of a top wall extending rearwardly from the face wall, a power shaft in the body clamshelled between the forward portion and the rear portion and having a forward end engaging the face wall, and means to preload the power shaft in the body including means for attaching the forward portion to the rear portion to achieve the preload.

19. A golf club head as defined in claim 18, wherein the means to attach the forward portion to the rear portion includes means to place the top wall in tension.

20. A golf club head as defined in claim 19, including a plurality of ribs in the body extending generally forwardly and rearwardly therein positioned to resist the tension in the top wall.

21. A golf club head as defined in claim 20, wherein the ribs include a plurality of ribs on the face wall integral with ribs extending rearwardly in the body.

22. A golf club head as defined in claim 18, wherein the means to place the top wall in tension includes a weldment.

23. A golf club head as defined in claim 18, including a press-fit connection between the power shaft and the forward face wall.

24. A golf club head as defined in claim 23, wherein the body is formed in a forward portion and rear portion and the power shaft is clamshelled in between, said power shaft being formed separately from the forward and rear portions and thereafter assembled thereto, said press-fit connection including a tapered socket integral with the face wall and a tapered end on the power shaft engaging the tapered socket.

25. A golf club head as defined in claim 18, wherein the body includes a bottom wall or sole plate wall that encloses the power shaft and prevents access to the power shaft after the sole plate wall is in position.

26. A golf club head as defined in claim 18, wherein the power shaft has a piston at the rear end thereof, and means to vary the preload including a threaded member engaging the piston.

27. A golf club head as defined in claim 18, wherein the club head has a volume of at least 240 $cm.^3$ and the club head and power shaft are constructed of titanium.

28. A golf club head as defined in claim 18, wherein the face wall has a ball striking face area of at least 30 $cm^2$.

29. A golf club head as defined in claim 18, wherein the face wall has a ball striking face area in the range of about 30 $cm^2$ to 45 $cm^2$.

30. A golf club head as defined in claim 18, wherein the face wall has a height of at least 40 mm.

31. A golf club head as defined in claim 18, wherein the body is formed by a forward portion including the face wall and a portion of the top wall, and a rear portion including a portion of the top wall, said forward portion and rear portion being joined together by welding, said power shaft being constructed of a piece separate from the forward portion and rear portion and clamshelled in between during assembly.

32. A golf club head with a rigidified forward face wall, comprising: a club head body having a forward portion and a separately made mating rear portion, said forward portion including a face wall and a portion of a top wall extending rearwardly from the face wall, a power shaft in the body clamshelled between the forward portion and the rear portion and having a forward end engaging the face wall, means to preload the power shaft in the body including means for attaching the forward portion to the rear portion to achieve the preload, and means to clamshell the power shaft in the body including the same means for attaching the forward portion to the rear portion.

33. A method of manufacturing a golf club head, including the steps of forming a club head forward portion including a face wall and a portion of a top wall, forming a club head rear portion with a portion of a top wall complementing the top wall portion on the forward portion, forming a power shaft, placing the power shaft between the forward portion and the rear portion, and attaching the forward portion to the rear portion and including the step of prior to attaching the forward portion to the rear portion, applying oppositely directed forces against the forward portion and rear portion to preload the power shaft, and thereafter while the preload remains in the power shaft, attaching the forward portion to the rear portion to maintain a substantial portion of the preload on the power shaft after said attachment.

34. A method of manufacturing a golf club head, including the steps of forming a club head forward portion including a face wall and a portion of a top wall, forming a club head rear portion with a portion of a top wall complementing the top wall portion on the forward portion, forming a power shaft, placing the power shaft between the forward portion and the rear portion, and attaching the forward portion to the rear portion, the step of forming the forward portion including forming a tapered socket on the rear of the face wall, said step of forming the power shaft includes forming the power shaft with a taper on the forward end thereof, said step of placing the power shaft between the forward portion and the rear portion includes inserting the tapered end of the power shaft tightly in the face wall socket.

35. A method of manufacturing a metal golf club head, including the steps of forming a golf club head forward portion constructed of a metallic alloy having a face wall and a portion of a top wall, forming a club head rear portion constructed of a metallic alloy including a portion of the top wall complementary to the top wall portion on the front portion, forming a power shaft, positioning the power shaft between the forward portion and the rear portion, clamping the forward portion to the rear portion, and welding the forward portion to the rear portion while clamped, including the step of prior to attaching the forward portion to the rear portion, applying oppositely directed forces against the forward portion and rear portion to preload the power shaft, and thereafter while the preload remains in the power shaft, attaching the forward portion to the rear portion to maintain a substantial portion of the preload on the power shaft after said attachment.

36. A method of manufacturing a metal golf club head, including the steps of forming a golf club head forward portion constructed of a metallic alloy having a face wall and a portion of a top wall, forming a club head rear portion constructed of a metallic alloy including a portion of the top wall complementary to the top wall portion on the front portion, forming a power shaft, positioning the power shaft between the forward portion and the rear portion, clamping the forward portion to the rear portion, and welding the forward portion to the rear portion while clamped, the step of forming the forward portion including forming a tapered socket on the rear of the face wall, said step of forming the power shaft includes forming the power shaft with a taper on the forward end thereof, said step of placing the power shaft between the forward portion and the rear portion includes inserting the tapered end of the power shaft tightly in the face wall socket.

37. A method of manufacturing a metallic golf club head, including the steps of: forming a club head forward portion constructed of a metal alloy and having a face wall, and a top wall portion, forming a club head rear portion of a similar metal alloy having a top wall portion complementary to the top wall portion on the forward portion, forming a power shaft either separately from or with one of the forward and rear portions, positioning the power shaft between the forward portion and rear portion, clamping the forward and rear portions toward one another, increasing the clamping force on the forward and rear portions to a predetermined value to preload the power shaft, welding the forward portion to the rear portion, and allowing the weld to cool sufficiently while maintaining the clamping force to maintain a substantial portion of the preload in the power shaft.

38. A method of manufacturing a metallic golf club head as defined in claim 37, wherein the step of forming the forward portion includes forming a tapered socket on the rear of the face wall, said step of forming the power shaft includes forming the power shaft with a taper on the forward end thereof, said step of placing the power shaft between the forward portion and the rear portion includes inserting the tapered end of the power shaft tightly in the face wall socket.

39. A club head with a preloaded power shaft, comprising: a club head body including a face wall, a toe wall, a heel wall and a top wall with a hosel extending in the body, said body having a forward portion and a rear portion defined by the walls and a hollow interior, a power shaft in the hollow interior between the forward portion and the rear portion, and means to resist the forces in the walls caused by the power shaft including a plurality of ribs on the face wall, and a plurality of ribs collectively on one or more of the toe wall, the heel wall, and top wall integral with the ribs on the face wall and extending rearwardly therefrom.

40. A club head with a preloaded power shaft as defined in claim 39, wherein said power shaft is preloaded between the forward portion and the rear portion and the integral ribs resists the tensile forces in the walls caused by the power shaft preloading.

41. A club head with a preloaded power shaft as defined in claim 39, wherein each of the toe wall, heel wall and top wall has an integral rib extending rearwardly from the face wall.

42. A golf club head, comprising: a club head body including a face wall, a top wall extending rearwardly from an upper portion of the face wall, a sole plate wall extending rearwardly from a lower portion of the face wall, and a hosel in the body, means to increase the rigidity and modulus of elasticity of the face wall including a power shaft extending generally along a target line from a forward portion of the body to a rear portion of the body, and means to enhance the columnar strength of the power shaft including means to integrally join one of the top wall and sole plate wall to the power shaft at points on the power shaft between the points when the power shaft is joined to the forward and rear portions of the club head body.

43. A golf club head as defined in claim 42, wherein one of the sole plate wall and top wall are integrally joined to the power shaft along a substantial axial extent of the power shaft to further increase the columnar strength of the power shaft without a significant increase in total club head weight.

44. A golf club head as defined in claim 42, wherein the sole plate wall has a central spheroidal upwardly extending portion that is integrally joined to the sides of the power shaft.

* * * * *